US009604739B2

(12) United States Patent
Bouix et al.

(10) Patent No.: US 9,604,739 B2
(45) Date of Patent: Mar. 28, 2017

(54) COMPACT CASE WITH CAKE RETENTION PAN

(71) Applicant: ELC Management LLC, Melville, NY (US)

(72) Inventors: Herve F. Bouix, New York, NY (US); Francis Corbellini, Thiais (FR)

(73) Assignee: ELC Management LLC, Melville, NY (US)

( * ) Notice: Subject to any disclaimer, the term of this patent is extended or adjusted under 35 U.S.C. 154(b) by 0 days.

(21) Appl. No.: 14/058,590

(22) Filed: Oct. 21, 2013

(65) Prior Publication Data

US 2014/0165507 A1 Jun. 19, 2014

Related U.S. Application Data

(62) Division of application No. 13/361,272, filed on Jan. 30, 2012.

(51) Int. Cl.

| | |
|---|---|
| ***A45D 33/00*** | (2006.01) |
| ***B65B 1/04*** | (2006.01) |
| ***B65B 1/20*** | (2006.01) |
| ***B65D 1/40*** | (2006.01) |

(52) U.S. Cl.

CPC ..... *B65B 1/04* (2013.01); *A45D 33/006* (2013.01); *B65B 1/20* (2013.01); *B65D 1/40* (2013.01); *A45D 2200/051* (2013.01)

(58) Field of Classification Search

CPC ..... A45D 33/006; A45D 33/003; A45D 33/0043; A45D 2040/0043

USPC ..... 132/293, 301, 303–305, 298, 299; 206/581, 823, 235; 220/324, 326, 344; 53/453, 559

See application file for complete search history.

(56) References Cited

U.S. PATENT DOCUMENTS

| | | | | |
|---|---|---|---|---|
| 1,625,669 A | | 4/1927 | Lyon | |
| 1,735,482 A | | 11/1929 | Wacker | |
| 1,835,951 A | * | 12/1931 | Kendall | 132/305 |
| 2,797,839 A | | 7/1957 | Root | |
| 3,103,089 A | * | 9/1963 | Allen | 53/471 |

(Continued)

FOREIGN PATENT DOCUMENTS

| | | |
|---|---|---|
| CN | 201042268 | 4/2008 |
| EP | 0685182 | 12/1995 |

(Continued)

OTHER PUBLICATIONS

PCT International Search Report; International Application No. PCT/US2013/020136; Completion Date: Apr. 26, 2013; Date of Mailing: Apr. 26, 2013.

(Continued)

*Primary Examiner* — Todd E Manahan
*Assistant Examiner* — Brianne Kalach
(74) *Attorney, Agent, or Firm* — Martin W. Haerter

(57) ABSTRACT

A cosmetic compact has a pan made from an elastomeric material. The pan is elastically biased to a size that is smaller than a pre-formed cake of cosmetic product. The empty pan is temporarily expanded by applying vacuum to a bottom and sidewalls of the pan. The cake of cosmetic is inserted in the expanded pan and the pan is released from the vacuum. The pan contracts toward the smaller size and thus traps and holds the cake in the compact.

4 Claims, 10 Drawing Sheets

(56) References Cited

U.S. PATENT DOCUMENTS

| | | | |
|---|---|---|---|
| 4,193,499 | A | 3/1980 | Lookholder |
| 4,337,859 | A | 7/1982 | Murphy et al. |
| 4,538,725 | A | 9/1985 | Glover et al. |
| 5,129,519 | A | 7/1992 | David et al. |
| 5,713,471 | A | 2/1998 | Gueret |
| 5,908,037 | A | 6/1999 | Pierson |
| 7,451,877 | B2 | 11/2008 | Koga et al. |
| 7,832,564 | B2 | 11/2010 | Kim |
| 2003/0183240 | A1 | 10/2003 | Manougian et al. |

FOREIGN PATENT DOCUMENTS

| | | | |
|---|---|---|---|
| JP | H02-119104 U | | 9/1990 |
| JP | 05-080408 | | 11/1993 |
| JP | H07313246 | | 12/1995 |
| JP | 2003-235636 | | 8/2003 |
| JP | 2004283387 | | 10/2014 |
| WO | WO87/07483 | | 12/1987 |
| WO | WO8707483 | * | 12/1987 |
| WO | WO2008/100828 | | 8/2008 |

OTHER PUBLICATIONS

Supplementary European Search Report; EP16175729; Completion Date: Sep. 30, 2016; Date of Mailing: Oct. 10, 2016.
Supplementary European Search Report; EP16175734; Completion Date: Sep. 29, 2016; Date of Mailing: Oct. 10, 2016.
Supplementary European Search Report; EP13743417; Completion Date: Nov. 23, 2015; Date of Mailing: Nov. 30, 2015.

* cited by examiner

COMPACT CASE WITH CAKE RETENTION PAN

CROSS-REFERENCE TO RELATED APPLICATIONS

The present application is a divisional application which claims priority from U.S. Non-provisional application Ser. No. 13/361,272, filed Jan. 30, 2012.

BACKGROUND OF THE INVENTION

1. Field of the Invention

The field of the invention is cosmetic packaging and in particular, cosmetic compacts with a pan for storing and dispensing pressed-powder, cake-type or solid cosmetics. The pan is elastomeric and expands to receive the cake during assembly.

2. Description of the Prior Art

U.S. Pat. No. 1,735,482 to Wacker discloses a compact case with a body, a frame and a pan shaped base carrying cosmetic that is pressed into the frame. The pan is not elastic. U.S. Pat. No. 4,337,859 to Murphy et al. discloses a compact with a cover and a casing defining a cavity. The cover is closed and the casing is inverted to fill the cavity through the bottom. There is no elastic pan and the cake is formed in the cavity.

BRIEF SUMMARY OF THE INVENTION

The invention is a cosmetic compact with a pan having a reservoir that is temporarily expanded to insert a pre-formed cake of cosmetic product. The reservoir is elastically biased to a size that is smaller than a size of the cake. After the cake is inserted, the reservoir contracts toward the smaller size and thus traps the cake to securely retain it in the compact. The pan is made from an elastomeric material. It can be expanded or stretched by, for example, applying a vacuum to the underside and sidewalls of the pan. The reservoir is temporarily expanded to a size that is larger than the cake. After the cosmetic cake is dropped into the expanded reservoir, the vacuum is released and the pan returns toward its unexpanded smaller size, thus trapping the cake and securely retaining it in the pan within the compact.

There are several advantages to the invention. During insertion of the cake on the manufacturing filling line, the cake, which is slightly smaller than the expanded pan, can be dropped readily into the reservoir and secured in the pan when the vacuum is released to allow the pan to return to the unexpanded size. The process is relatively gentle, avoiding product loss or damage such as scuffing, scratching, cracking or breaking. The amount of force applied to the cake by the unexpanded pan is selectable, for example, based on the type and thickness of elastomer, construction details, etc. Furthermore, the predetermined size of the cosmetic cake is larger than the smaller initial size of the reservoir in the pan, so if the cake shrinks over time (due, for example, to volatile evaporation, loss of solvent or water), the reservoir of the elastomeric pan shrinks along with the cake to compensate for any reduction in size of the cake. The elastomeric pan also acts like a shock absorber. In the preferred embodiment, the pan is 'floating' or suspended with a clearance between it and the outside walls. A compact with a cake cosmetic secured in the elastomeric pan is thus able to survive more severe shocks—the ability to survive drop tests is increased. Also, a flange integrally molded with and extending from the pan may serve as an elastomeric seal between the cover and the frame, shell or base of the compact. Any plan view shape of the pan is possible. For example, the pan with corresponding reservoir may be round, square, rectangular or any other suitable shape in plan view. The invention may be used as a compact pan associated with holding typical cake cosmetics or personal care products in any form, including solids, pressed powders, etc., as well as for cup-like holders such as those used in stick cosmetic, personal care product and lipstick risers to retain a stick, bar, bullet or pomade.

DETAILED DESCRIPTION OF THE INVENTION

Figure 1:
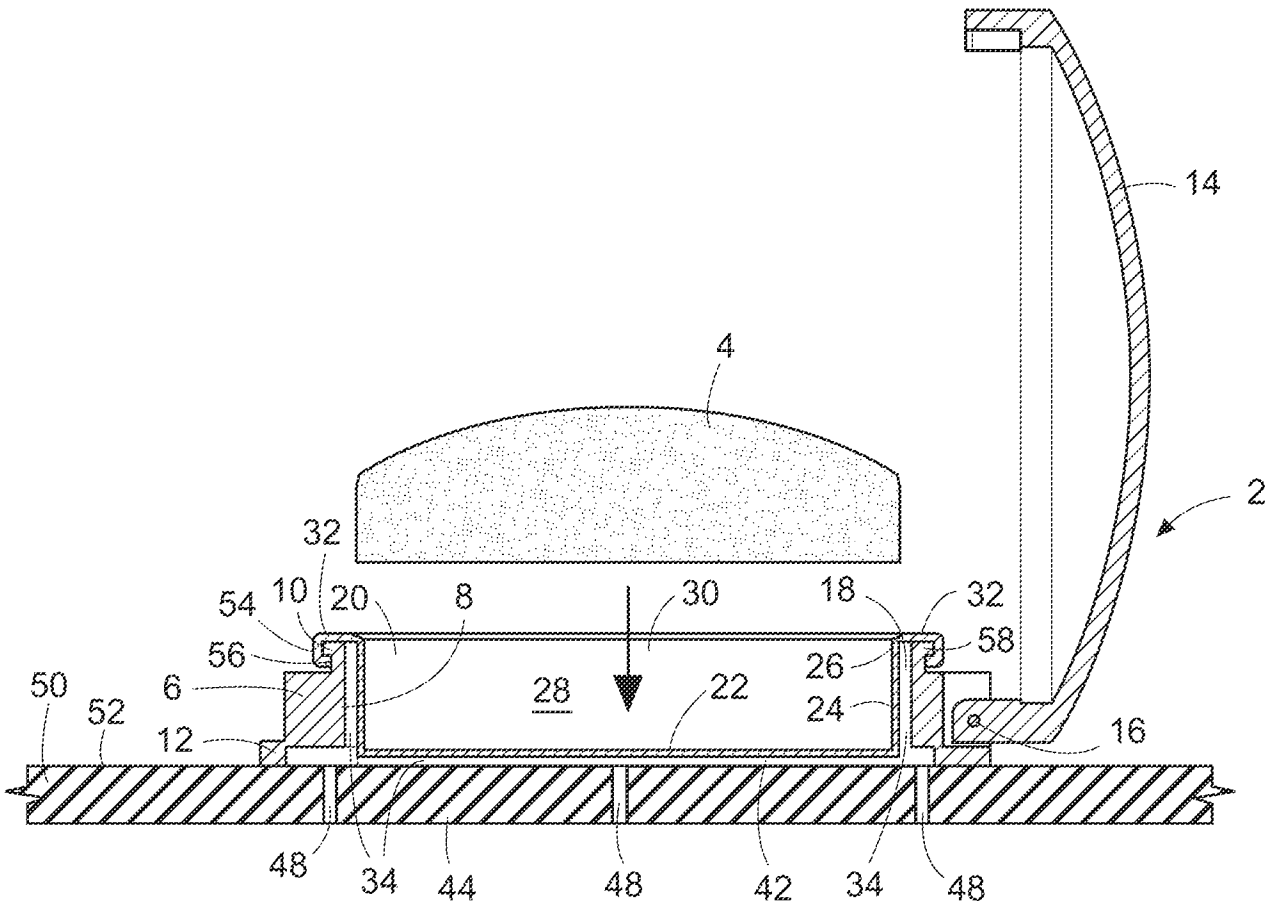
FIG. 1 is a sectional side elevation view of a first embodiment of a compact of the present invention with the lid open, a cake in a position above the elastomeric pan prior to expansion of the pan.
Figure 2:
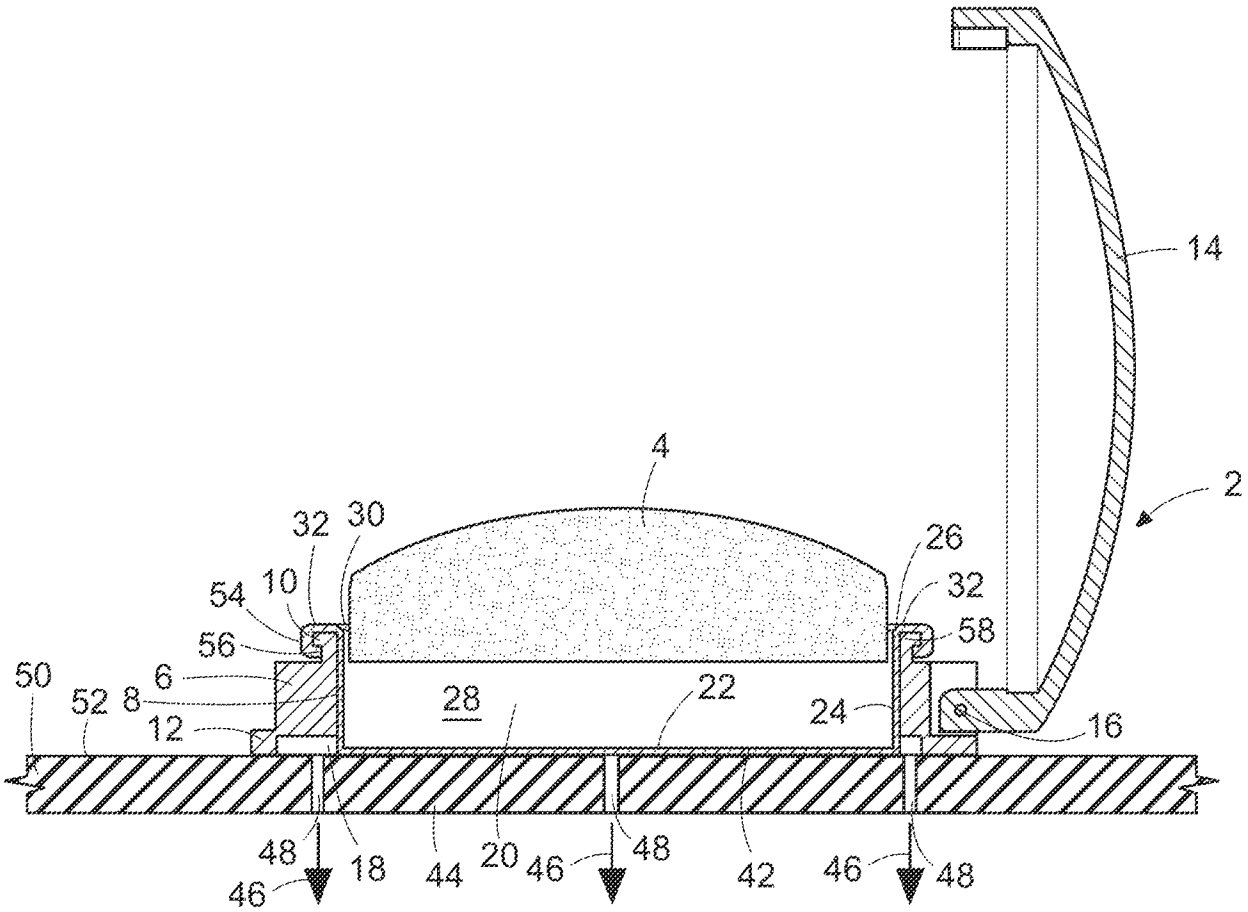
FIG. 2 is a sectional side elevation view of the compact shown in FIG. 1 with vacuum applied from below to expand the reservoir of the pan and the cake partially inserted in the reservoir.
Figure 3:
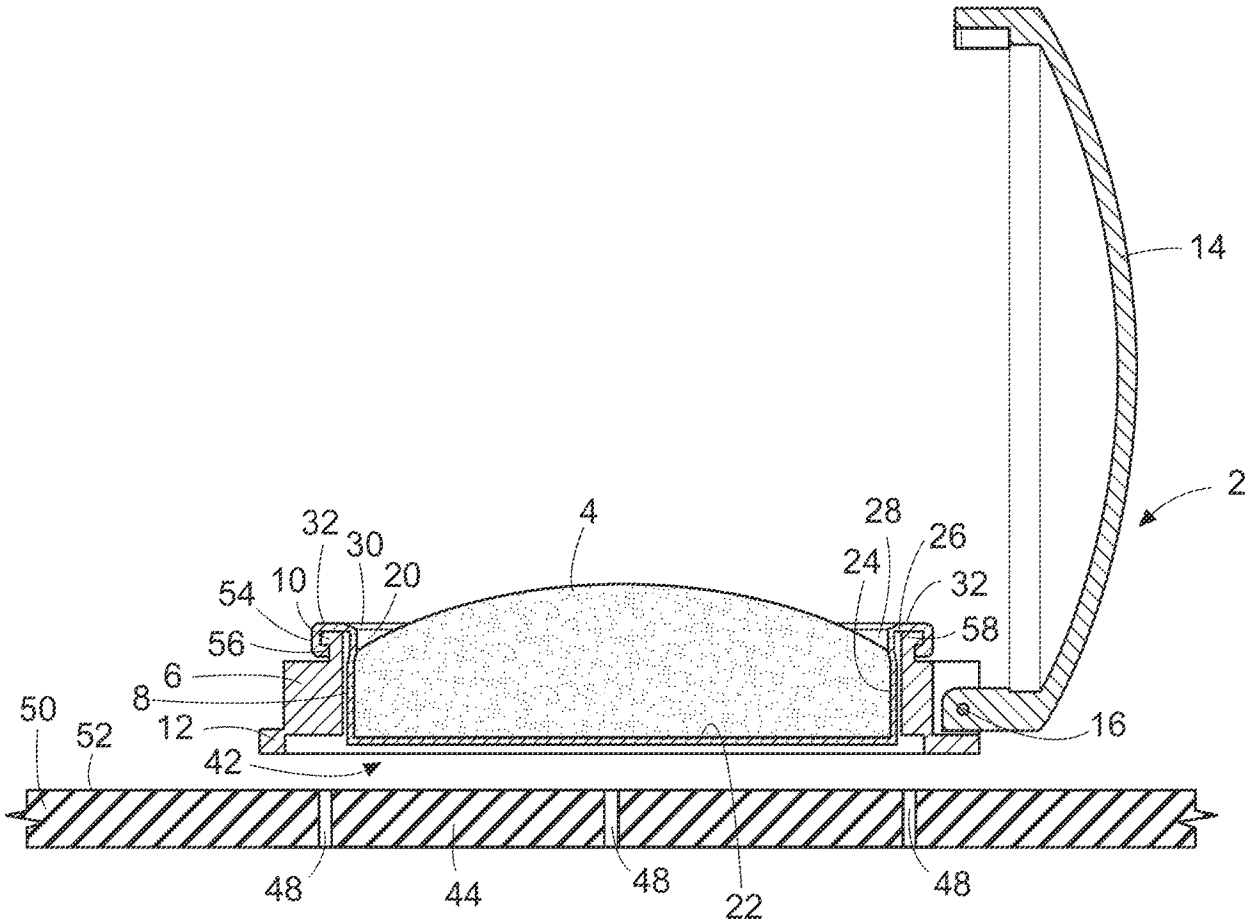
FIG. 3 is a sectional side elevation view of the compact shown in FIGS. 1 and 2 with the cake fully inside the reservoir, the vacuum released and the reservoir contracted towards its smaller size to trap the cake.

Referring to FIGS. 1-3, a compact 2 is shown for receiving a cake 4 of cosmetic composition. The cake 4 is shown as a puck-shaped form, but may alternatively be in the form of a bar, pomade, stick, block, bullet or other typical cosmetic product form. In plan view, the cake 4 may be round, oval, square, rectangular, hexagonal, triangular, octagonal or any other suitable shape. The cosmetic comprising the cake 4 may be a color cosmetic (e.g., an eye shadow, lip gloss, lipstick, rouge, foundation, etc.), a treatment product (e.g., spot remover, self-tanner, etc.), a moisturizing product (hydrating cream, etc.), a fragrance, or any other cosmetic or personal care product that can be suitably provided in cake form. The cake 4 may be a solid, pressed powder, paste or semi-paste, crystalline, lattice, or other suitable form that is wax based, wax-free, soap based, etc. The cake 4 has a predetermined size, i.e., the size determined by the manufacturing process used to make the cake. The cake 4 may be of the type that is formed by pressing loose particles with a binder in a mold cavity, or they may be slurry formed, or emulsions. The final form may also be achieved by injection molding, caste molding, extruding and cutting, die cutting, punching or other suitable manufacturing means and combinations thereof.

The compact 2 comprises a rigid frame 6 with an upright wall 8 having a top rim 10 and a bottom rim 12. A cover 14 is pivotally attached to the frame 6 by a hinge 16 such that it can swing from an open position (shown) allowing access to the contents of the compact to a closed position (not shown) covering the contents of the compact. Instead of a hinge, the cover can be attached by snap fit or cooperating threads, etc. (not shown). The upright wall 8 defines an upwardly opening chamber 18 with a bottom end 42 defined by the bottom rim 12.

A pan 20 is provided that is dimensioned to be received in the chamber 18 with a clearance 34 between the outside of the portion of the pan in the chamber 18 and the inside of the chamber 18 to allow for expansion of that portion of the pan. The pan has a floor 22 and a sidewall 24 extending upwardly from the floor 22 to a top end 26. The floor 22 and the sidewall 24 define a reservoir 28 with an upwardly directed opening 30 at the top end 26. The reservoir 28 is adapted for receiving and holding the cake 4. The pan 20 is made from an elastic material and is elastically biased toward the reservoir 28 having a first volume that is smaller than the predetermined size of the cake 4. The pan 20 is further adapted to be expanded by means for expansion such that the reservoir 28 expands from the first volume to a second volume that is large enough to permit insertion of the predetermined size of the cake into the reservoir. When the pan 20 is released from the means for expansion, the reservoir 28 contracts toward the first volume, causing it capture and securely hold or grasp the inserted cake 4.

A horizontal flange 32 integrally formed with and extending outwardly from the top end 26 of the sidewall 24 is secured to the top rim 10 of the frame 6. In this way, the pan 20 is secured in the chamber 18 of the frame 6 such that the clearance 34 is defined at least between the upright wall 8 of the frame 6 and the sidewall 24 of the pan 20. Preferably, the clearance 34 also extends below the floor 22 of the pan 20. The clearance 34 is of sufficient size to accommodate expansion at least of the reservoir portion of the pan 20 to the second volume of the reservoir 28.

The means for expansion may be mechanical means, such as, for example, an expander or a spreader with 'shoe-horn' type blades (not shown) inserted temporarily into the reservoir to mechanically expand the reservoir. Alternatively, the mechanical means may comprise an external structure (not shown) of the pan 20 that can be pulled outwardly, such as, for example, outwardly directed tabs, rims, studs, hooks, loops or other devices.

As another alternative, the means for expansion may comprise the cake itself, wherein force-fitting the cake into the reservoir expands the reservoir sufficiently to seat the cake in the reservoir.

In a preferred embodiment, the flange 32 is integrally formed with and extends outwardly from the top end 26 of the sidewall 24 and is hermetically secured to the top rim 10 of the frame 6. The means for expansion is vacuum applied to the chamber 18 through the open bottom 42 of the frame 6. The vacuum applied to the chamber 18 causes the pan 20 to expand within the chamber 18, and in particular into the clearance 34, to the second volume that is large enough to permit insertion of the predetermined size of the cake into the reservoir.

Figure 7:
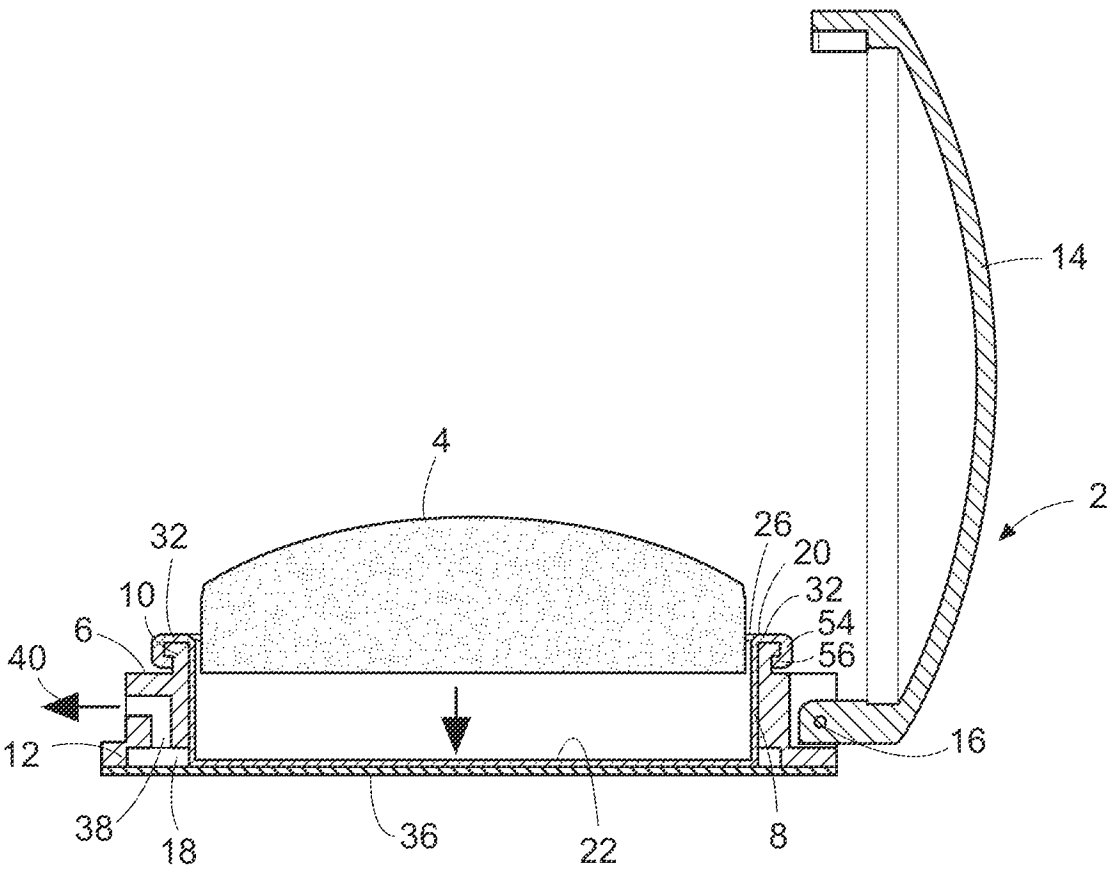
FIG. 7 is a sectional side elevation view of an embodiment of the compact with a closed bottom.

In an embodiment shown in FIG. 7, the flange 32 forms a hermetic seal with the top rim 10 of the frame 6, and a bottom wall 36 is hermetically secured to the bottom rim 12 of the frame 6 such that chamber 18 is closed at the bottom end by wall 36 and closed at the top by the pan 20. Vacuum is applied (as indicated by directional arrow 40) to the chamber 18 through a port 38 in the frame 6. The vacuum causes the reservoir portion of the pan 20 to expand into and temporarily at least partially occupy clearance 34 (as shown in FIG. 1) while the cake 4 is inserted in the reservoir 28.

In the preferred embodiment shown in FIGS. 1-3, the flange 32 forms a hermetic seal with the top rim 10 of the frame 6, and the frame 6 has the open bottom 42 (as best seen in FIG. 3) and the bottom rim 12 is adapted to be temporarily sealed against a vacuum source 44. The vacuum source 44 may include, for example, a vacuum table or a vacuum conveyor belt 50 with one or more bores 48 providing fluid communication between a vacuum source below the table or conveyor (as indicated by directional arrows 46 in FIG. 2) and chamber 18 in the frame 6. In FIG. 1, the bottom rim 12 of frame 6 is in sealing contact with the surface 52 of the vacuum source 44, but the vacuum has not yet been applied. The pan 20 is still in its fully contracted state wherein the first volume of the reservoir 28 is smaller than the predetermined size of the cake 4. Clearance 34 can clearly be seen below and to the sides of the pan 20. FIG. 2 illustrates the pan 20 while vacuum is being applied to the chamber 18 through bores 48. The reservoir portion of the pan 20 has expanded such that the reservoir 28 has enlarged from the first volume smaller than the cake 4 to a second volume that is large enough to permit insertion of the predetermined size of the cake 4 into the reservoir 28. The cake 4 is illustrated as partially positioned in the enlarged reservoir 28 as it is being lowered to its final position. The bottom and sidewall of the pan have been drawn downwardly and outwardly, respectively, into the clearance 34 by the application of vacuum to chamber 18. Finally, FIG. 3 illustrates the pan 20 in its final intended state with the cake 4 fully inserted in the reservoir 28, the compact is released from the application of vacuum and the reservoir 28 has contracted toward the first volume to securely grasp and hold the cake 4 in the pan. The clearance 34 appears again to a lesser extent than in FIG. 1 as the clearance is partially occupied by the dimension of the cake which is slightly larger than the first volume of the reservoir.

As the clearance 34 is at least partially restored after release of the application of vacuum, the pan 20 containing the cake 4 'floats' or is suspended on flange 32, which is made of the same elastomeric material as the rest of the pan.

This arrangement provides a cushioning or shock absorbing effect that protects the cake 4 from damage in the form of cracks or breakage.

While the cake 4 is illustrated as being inserted in the reservoir 28 in 'naked' form, i.e., free of a supporting metal, paper or rigid plastic plate, dish, tray or pan such as that typically found in compacts, it should be apparent that a cake supported in or on a metal, paper or rigid plastic plate, dish, tray or pan can similarly be inserted in the reservoir of the elastomeric pan of the present invention. In fact the invention can be adapted to an existing compact to improve manufacturing, potentially minimize parts (e.g., by eliminating the metal or rigid plastic pan), minimize waste due to damage during manufacture and improve durability in shipping and in use by improving shock resistance. The invention further eliminates the need for glue to secure to the compact case a naked cake, or a metal, paper or rigid plastic plate, dish, tray or pan containing a cake, because the pan 20 is secured to the frame 6 by the flange 32, and because in a contracted state the pan 20 firmly grasps the cake 4, either naked or supported in a plate, dish, tray or pan. By eliminating the need for glue to retain the cake, the present invention significantly streamlines and improves the assembly process by eliminating the step of applying glue, and eliminating the associated costly glue applying equipment and processes (e.g., handling, clean-up and maintenance of the glue and equipment).

The frame 6 is preferably made of a substantially rigid and impermeable material, such as, for example, a rigid plastic. One example of a suitable rigid plastic is polypropylene, although other plastics may be suitable. The pan 20 is preferably made from a suitable elastomeric material such as, for example, a thermoplastic elastomer such as Santoprene (a registered trademark of Exxon Mobil). The frame 6 and or pan 20 can be molded from their respective suitable materials by conventional molding processes such as injection molding.

The pan 20 can be assembled to the frame 6 after each has been molded separately by hermetically securing the flange 32 to the top rim 10 of the frame 6 by, for example, at least one of welding, cementing, staking, friction fit or snap fit. Alternatively, the pan 20 and frame 6 can be molded together by, for example, bi-injection molding or overmolding if the materials are selected for compatibility for such molding. In the embodiment shown in FIGS. 1-3, after assembly of the parts and insertion of the cake, a bottom panel 36 can be added as shown in FIG. 7 with respect to another embodiment.

A skirt 54 may depend from an outer edge of the flange 32. The top end 26 of the sidewall 24 may thus be secured to the top rim 10 of the frame 6 by at least one of the flange 32 or the skirt 54 as illustrated in FIGS. 1-3. A bead 56 may project inwardly from a bottom end of the skirt 54. The top end of the sidewall 24 may thus be secured to the top rim 10 of the frame 6 by at least one of the flange 32, the skirt 54 or the bead 56, or the combination thereof. The skirt 54, or the skirt 54 and bead 56 combined, allow the pan 20 to be snap fit on a shoulder 58 on an outer perimeter of the top rim 10. To better effect the vacuum expansion of the reservoir portion of the pan 20, preferably at least one of the flange 32, the skirt 54 or the bead 56 seals hermetically to the top rim 10 of the frame 6 at least when the vacuum is applied to chamber 18.

Figure 4A:
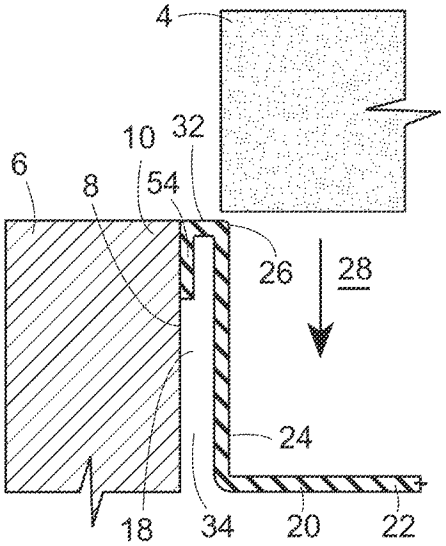
FIGS. 4A-4C are partial sectional detail views of a second embodiment of the invention.
Figure 4B:
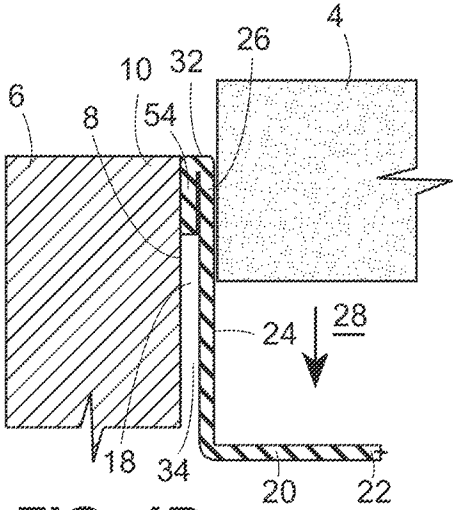
Figure 4C:
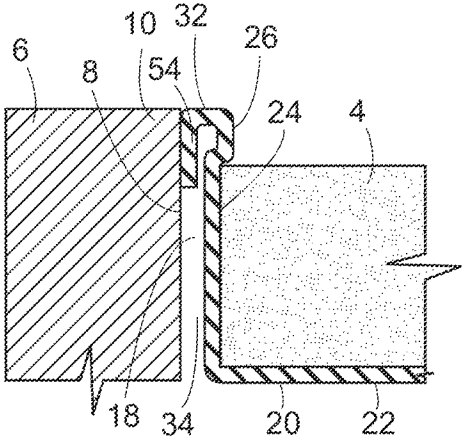
Figure 6:
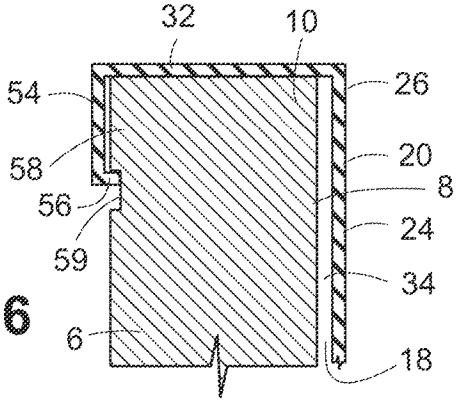
FIG. 6 is a partial sectional detail view of a fourth embodiment of the invention.
Figure 5:
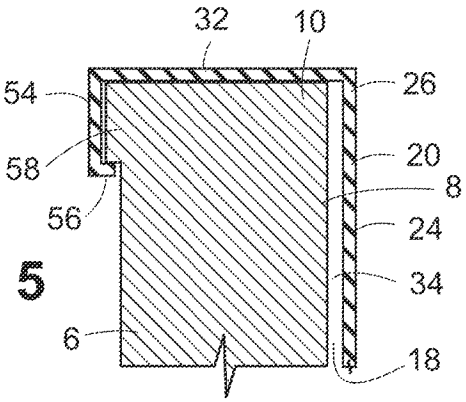
FIG. 5 is a partial sectional detail view of a third embodiment of the invention.

Alternatively, as shown in FIGS. 4A-4C, the top end 26 of the sidewall of the pan 20 can be attached to the top rim 10 of the frame 6 by securing the flange 32 and/or the skirt 54 to a top or an inner surface of the upright wall 8 of frame 6. The flange 32 and/or skirt 54 can be secured to the wall 8 by welding, cementing, staking or friction fit. FIGS. 5 and 6 illustrate how shoulder 58 on the outer perimeter of the top rim 10 provides cooperative structure to receive flange 32, skirt 54 and bead 56 in snap-fit engagement. FIG. 6 illustrates a groove 59 for receiving bead 56.

The flange 32 and/or the skirt 54 may be adapted to form a seal between the pan 20 and the cover 14 when the cover 14 is in the closed position.

The invention is also directed to a method for securing a cake of cosmetic product in a compact case. The case has a frame defining a chamber. The cake has a predetermined size. The method comprises a first step of providing an elastomeric pan in the chamber in the case. The pan has a floor and a sidewall defining a cake retention reservoir biased toward a first volume smaller than the predetermined size of the cake. The pan is adapted such that the reservoir is expandable to a second volume that is large enough to permit insertion of the cake into the reservoir. The method further comprises the step of providing means for expanding the elastomeric pan from the first volume to the second volume, and subsequently using the means for expanding to expand the elastomeric pan from the first volume to the second volume. The next step is inserting the cake into the reservoir. The final step is releasing the pan from the means for expanding, wherein the reservoir contracts toward the first volume to securely hold the inserted cake.

The invention is also directed to a compact for receiving a cake of cosmetic composition having a predetermined size as described above with a rigid frame and a pan wherein means for securing the pan to the frame other than a flange are provided. The compact comprises a rigid frame with an upright wall having a top rim and a bottom rim. The upright wall defines an upwardly opening chamber. A pan is provided that is dimensioned to be received in the chamber. The pan has a floor and a sidewall extending upwardly from the floor to a top end. The floor and the sidewall define a reservoir with an upwardly directed opening. The reservoir is adapted for receiving and holding the cake. The pan is made of an elastic material and is elastically biased toward the reservoir having a first volume that is smaller than the predetermined size of the cake. The pan is adapted to be expanded by means for expansion such that the reservoir expands from the first volume to a second volume that is large enough to permit insertion of the cake into the reservoir. The pan is subsequently released from the means for expansion to allow the reservoir to contract toward the first volume to securely trap and hold the inserted cake. Means are provided for securing the pan to the frame in the chamber such that a clearance is defined at least between the frame and the sidewall sufficient to accommodate expansion of the pan to the second volume of the reservoir. The means for securing may comprise a flange extending outwardly from the pan to the frame as described in more detail above. The flange may extend from the sidewall to the upright wall. The flange may extend from the top end of the sidewall to the top rim of the upright wall. Alternatively, the flange may extend from any point on the sidewall of the pan between the top end and the bottom to any point on the upright wall of the frame between the top rim and the bottom rim. As an alternative to a flange or in combination with a flange, the means for securing may be at least one of a stud, a rib, a beam, an arm, a web and a strut.

The invention is also directed to a pan for receiving a cake of cosmetic composition in a compact. The cake has a predetermined size. The compact has a rigid frame with an upright wall having a top rim and a bottom rim. The upright wall defines an upwardly opening chamber. The pan is dimensioned to be received in the chamber. The pan comprises a floor and a sidewall extending upwardly from the floor to a top end. The floor and the sidewall define a reservoir with an upwardly directed opening. The reservoir is adapted for receiving and holding the cake. The pan is made of an elastic material. The pan is elastically biased toward the reservoir having a first volume that is smaller than the predetermined size of the cake. The pan is adapted to be expanded by means for expansion such that the reservoir expands from the first volume to a second volume that is large enough to permit insertion of the cake into the reservoir. When the pan is released from the means for expansion, the reservoir contracts toward the first volume to securely trap, hold and retain the inserted cake.

The invention is also directed to a pan for holding a cake of cosmetic composition in a cosmetic compact. The cake has a predetermined size. The pan comprises a floor and a sidewall extending upwardly from the floor defining a reservoir with an upwardly directed opening. The reservoir is for receiving and holding the cake. Means are provided for securing the pan in the cosmetic compact. The pan is made from a shape memory polymer. The pan has a programmed expanded configuration in which the reservoir has a volume that is large enough to allow insertion of the cake having the predetermined size. The pan has a predetermined contracted configuration in which the reservoir has a volume that is smaller than the predetermined size of the cake. The pan changes from the programmed expanded configuration to the predetermined contracted configuration in response to an external stimulus applied to the pan subsequent to insertion of the cake in the reservoir. When the pan changes to the predetermined contracted configuration with a cake positioned in the reservoir, the cake is securely trapped and held by the contracted reservoir. The external stimulus may be a change in temperature, as used, for example, with shrink-wrap. The change in temperature may comprise one of heat or cold applied to the floor and/or sidewall of the pan. The change in temperature may be provided by at least one of a liquid bath or a gaseous stream, or a combination thereof. Alternatively, the external stimulus may be selected from at least one or a combination of electricity, magnetism, light, radio frequency, microwave or radiation. For example, microwave energy may be applied to the pan to cause the pan to shift from the programmed expanded configuration to the predetermined contracted configuration after inserting a cake in the reservoir. In this way, the cake is trapped and held in the contracted configuration of the pan reservoir.

Figure 10:
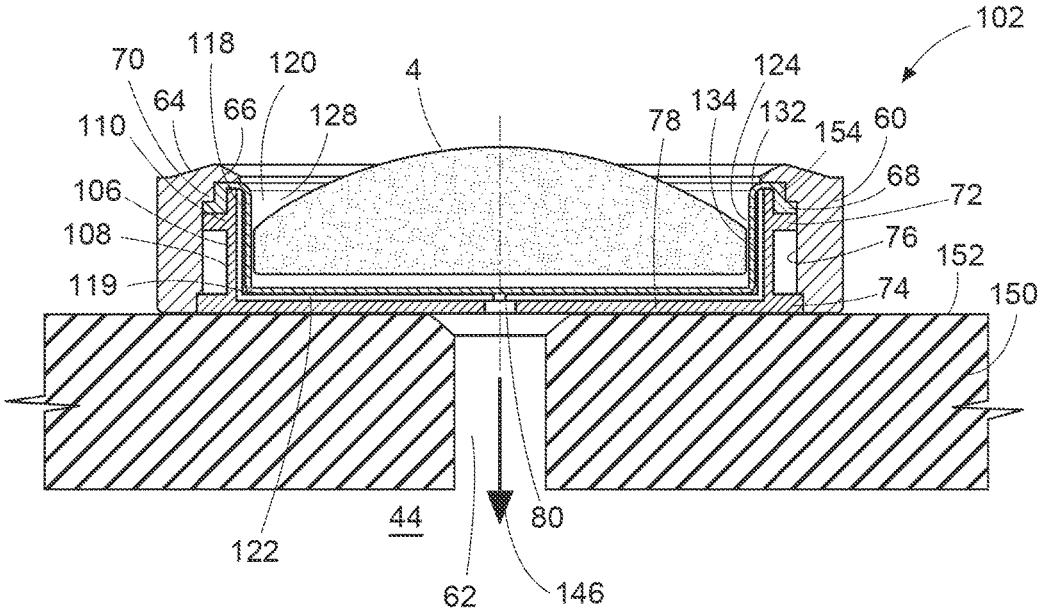
FIG. 10 is a sectional side elevation view of the compact shown in FIG. 8 with vacuum still applied from below to expand the reservoir of the pan and the cake partially inserted in the reservoir, the compact supported on the vacuum table/conveyor.
Figure 11:
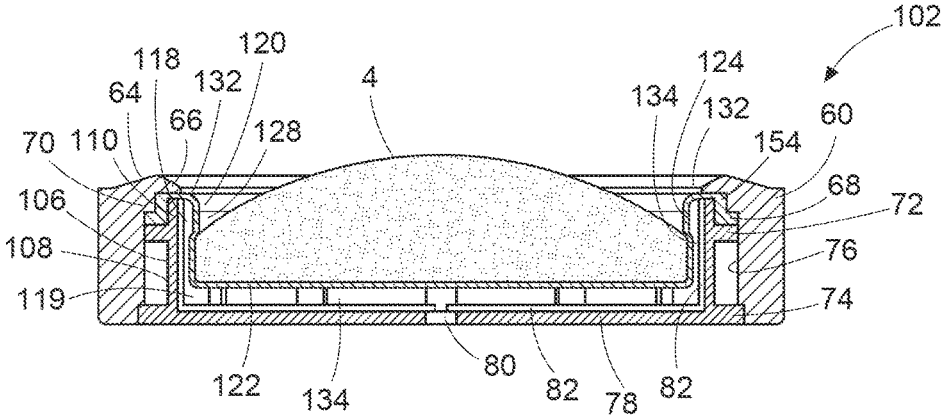
FIG. 11 is a sectional side elevation view of the compact shown in FIG. 8 with the cake fully inside the reservoir, the vacuum released and the reservoir contracted towards its smaller size to trap the cake, the compact removed from the vacuum table/conveyor.
Figure 12:
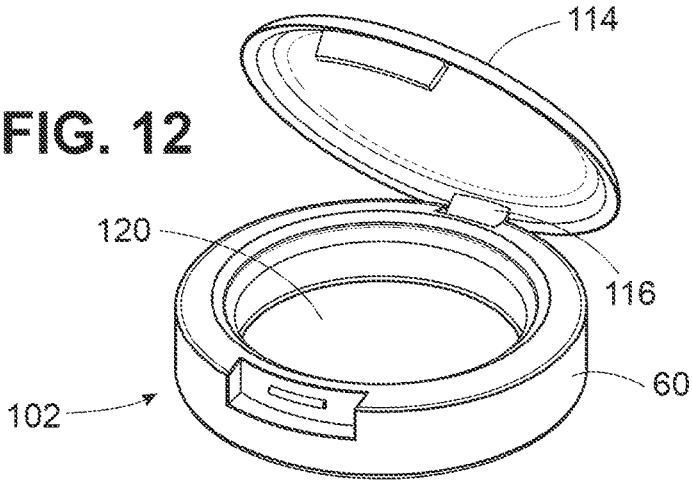
FIG. 12 is a perspective view of the embodiment of the compact shown in FIG. 8.
Figure 13:
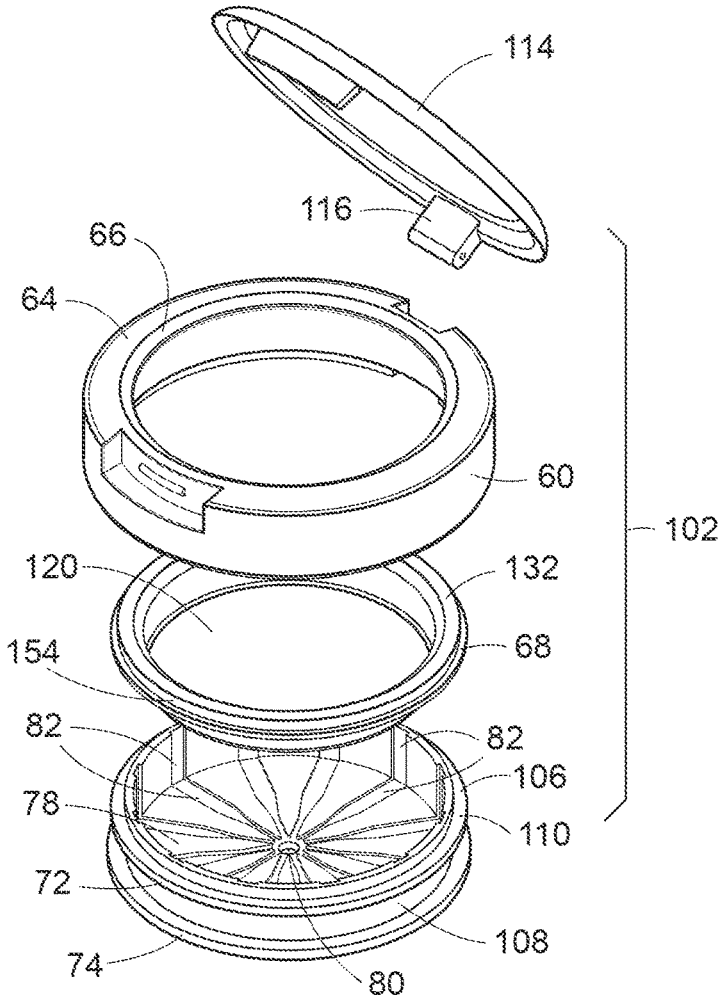
FIG. 13 is a perspective, exploded view of the compact shown in FIG. 8.

FIGS. 8-13 show another embodiment of the present invention wherein a compact 102 is round in plan view (see FIGS. 12-13). Compact 102 has a rigid frame 106 and pan 120 similar to frame 6 and pan 20 described above. The frame 106 and pan 120 are enclosed in an outer shell 60. A cover 114 (see FIGS. 12-13) is pivotally attached to the shell 60 rather than to the frame 106. The cover 114 is attached to the shell 60 by a hinge 116 such that it can swing from an open position (shown) allowing access to the contents of the compact to a closed position (not shown) covering the contents of the compact. Instead of a hinge, the cover can be attached by snap fit or cooperating threads, etc. (not shown).

The shell 60 provides a protective and/or decorative housing for the frame 106. As shown in FIGS. 8-11, an upper end 64 of the shell 60 may have an inwardly directed lip 66 that partially or entirely covers an outwardly directed flange 132 of the pan 120. The frame 106 has an upright wall 108 with a top rim 110. The upright wall 108 defines an upwardly opening chamber 118 with a bottom end 119. A bottom wall 78 closes the bottom end 119. The bottom wall 78 is adapted to be hermetically sealed selectively against a vacuum source 44. A vacuum port 80 is provided in the bottom wall 78 (but it may be provided in the side wall 108 as described above). In this embodiment, the flange 132 on the pan 120 has a depending skirt 154. The skirt 154 has an outwardly directed bead 68. The flange 132 and skirt 154 contact the top rim 110 of the frame 106. The shell may have an internal bearing structure 70 that is complementary in shape and dimensions to the shape and dimensions of the flange 132, skirt 154 and outwardly directed bead 68 such that the bearing structure forms a hermetic seal with at least one of the flange 132, skirt 154 or bead 68 when the shell 60 is secured to the frame 106. The frame 106 may be attached to the shell 60 by welding, adhering, staking, friction fit, snap fit or any other suitable means for attaching, including, if required, with fasteners such as rivets, pins or screws. For example, as illustrated, an outwardly directed circumferential upper rib 72 and an outwardly directed circumferential lower rib 74 extend from the upright wall 108 of the frame 106 to contact an inner surface 76 of the shell 60. At least one or both of the upper rib 72 and lower rib 74 may be secured to the inner surface 76 of the shell 60 by, for example, welding, adhering, staking, friction fit, press fit, snap fit or any other suitable means for attaching, including if required with fasteners such as rivets, pins or screws.

In the embodiment shown in FIGS. 8-13, the flange 132 (and/or alternatively, the skirt 154 and/or the bead 68) forms a hermetic seal with the top rim 110 of the frame 106. As noted above, the vacuum source 44 may include, for example, a vacuum applied through a vacuum bore 62 in a table or conveyor belt 150 in fluid communication with the vacuum source 44 (e.g., illustrated as being below the table or conveyor as indicated by directional arrows 146 in FIGS. 8-10). A clearance 134 is provided between the sidewall 124 of the pan 120 and the upright wall 108 of the frame 106, as well as between the floor 122 of the pan 120 and the bottom wall 78 of the frame 106. The vacuum port 80 in the bottom wall 78 provides fluid communication between the chamber 118 in the frame 106 and the vacuum source 44 by way of the bore 62 in the vacuum table or conveyor 150.

Figure 8:
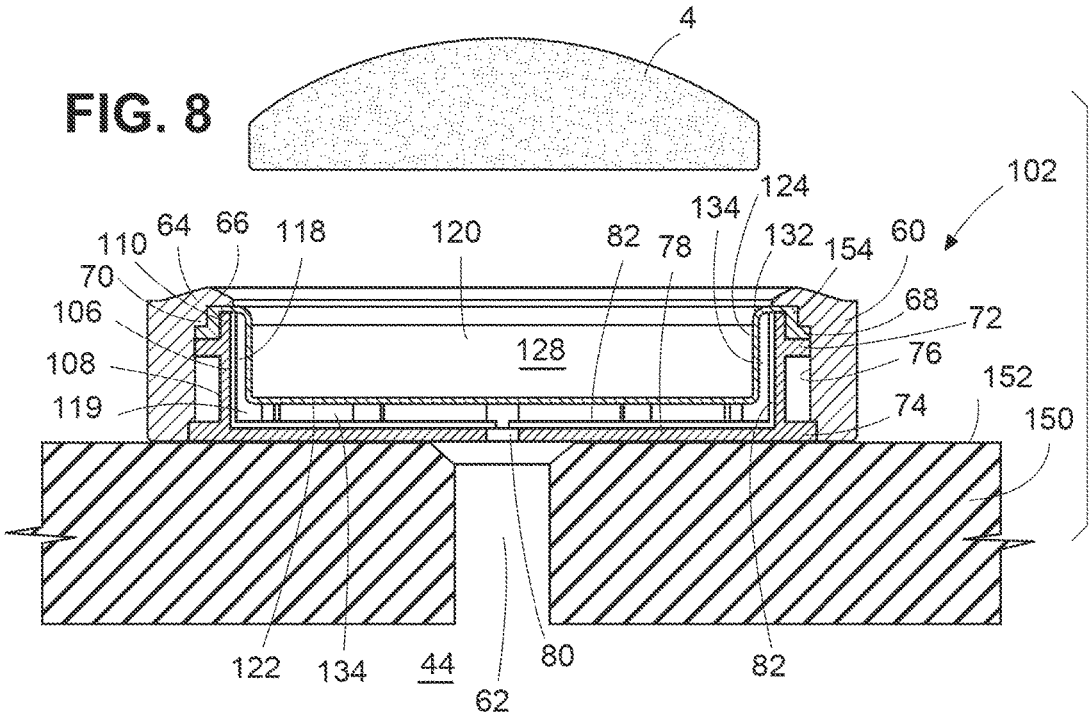
FIG. 8 is a sectional side elevation view of another embodiment of a compact of the present invention with a cake in a position above the elastomeric pan prior to expansion of the pan, the compact supported on a vacuum table/conveyor.
Figure 9:
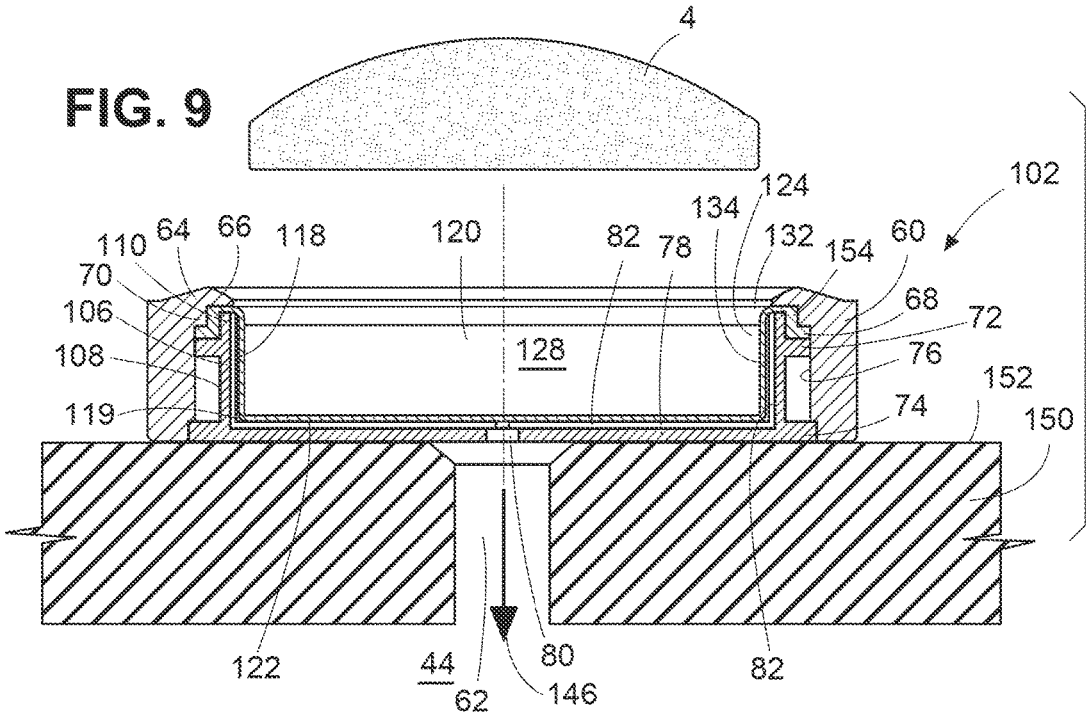
FIG. 9 is a sectional side elevation view of the compact shown in FIG. 8 with vacuum applied from below to expand the reservoir of the pan and the cake still in a position above the elastomeric pan prior to insertion, the compact supported on the vacuum table/conveyor.

In FIG. 8, the bottom wall 78 of frame 106 is in sealing contact with a surface 152 of the vacuum table 150, but the vacuum has not yet been applied. The pan 120 is still in its fully contracted state wherein the first volume of the reservoir 128 is smaller than the predetermined size of the cake 4. Clearance 134 can clearly be seen below and to the sides of the pan 120. FIG. 9 illustrates the pan 120 while vacuum is being fully applied to the chamber 118 through vacuum port 80 in bottom wall 78 and bore 62 in table 150. The reservoir portion of the pan 120 has expanded such that the reservoir 128 has enlarged from the first volume smaller than the cake 4 to a second volume that is large enough to permit insertion of the predetermined size of the cake 4 into the reservoir 128. The floor 122 and sidewall 124 of the pan have been drawn outwardly by the vacuum to occupy the clearance 34. The cake 4 is positioned above the expanded reservoir 128, about to be inserted. FIG. 10 illustrates the pan 120 while vacuum is being fully applied to the chamber 118 through vacuum port 80 via bore 62, with the cake 4 illustrated as nearly fully inserted in the enlarged reservoir 128 as the cake 4 is being lowered to its final position. Finally, FIG. 11 illustrates the pan 120 in its final state after the cake 4 is fully inserted in the reservoir 128, the pan 120 is released from the application of vacuum and the reservoir 128 has contracted toward the relatively smaller first volume to securely grasp and hold the cake 4 in the pan 120. The clearance 134 appears again to a lesser extent than in FIG. 8 as the clearance 134 is partially occupied by the dimension of the cake 4 which is slightly larger than the first volume of the reservoir 128.

In the embodiments shown in FIGS. 8-13, vacuum channels 82 are provided on the inner surfaces of the upright wall 108 of the frame 106 and the bottom wall 78 of the frame 106 (see also FIGS. 12-13). The vacuum channels 82 improve the evacuation of air from the chamber 118 when vacuum is applied through the vacuum port 62, and improve the return of air when the vacuum is released. This in turn ensures that the pan 120 will expand more quickly and to a sufficiently enlarged state when vacuum is applied, and also ensures quick and efficient return of air when the vacuum is released to allow contraction of the reservoir 128 around the cake 4. This improves the manufacturing cycle time for insertion of the cake into the pan.

As described above with reference to another embodiment, the pan 120 can be assembled to the frame 106 after each has been molded separately by hermetically securing the flange 132 to the top rim 110 of the frame 106 by, for example, at least one of welding, cementing, staking, friction fit or snap fit. The shell 60 can then be secured to the frame as described above. Alternatively, the pan 120 can be molded together with one or both of the frame 106 and shell 60 by, for example, bi-injection molding or over-molding if the materials are selected for compatibility for such molding.

Figure 14:
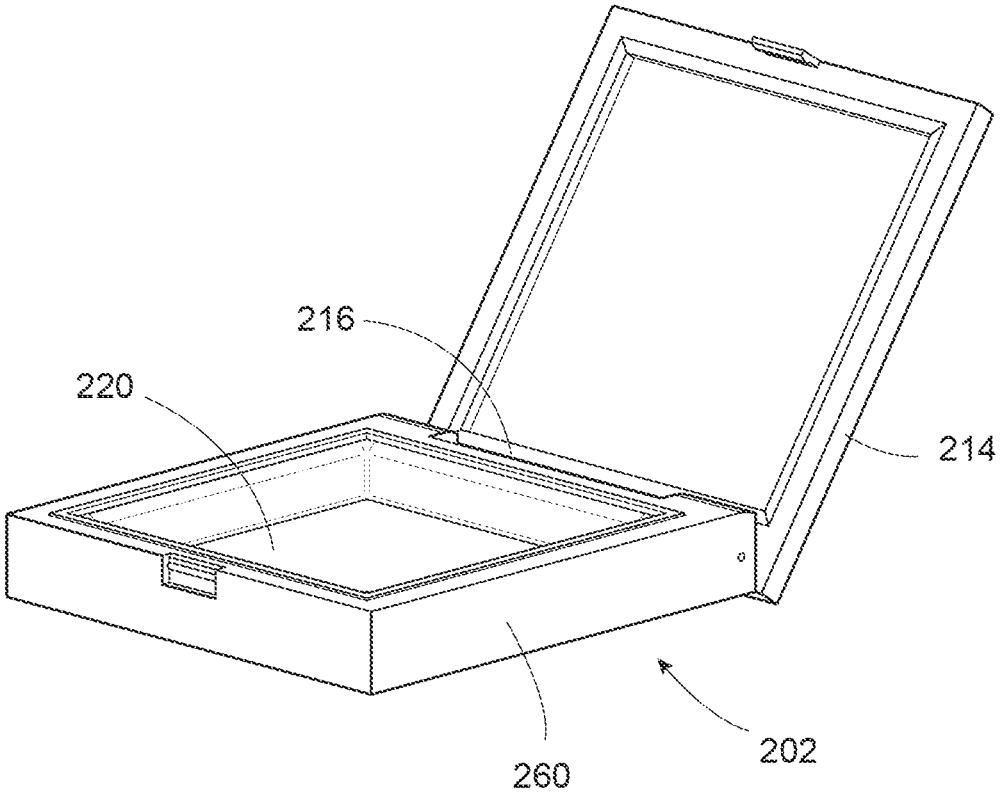
FIG. 14 is a perspective view of yet another embodiment of a compact of the present invention illustrating a square shape.
Figure 15:
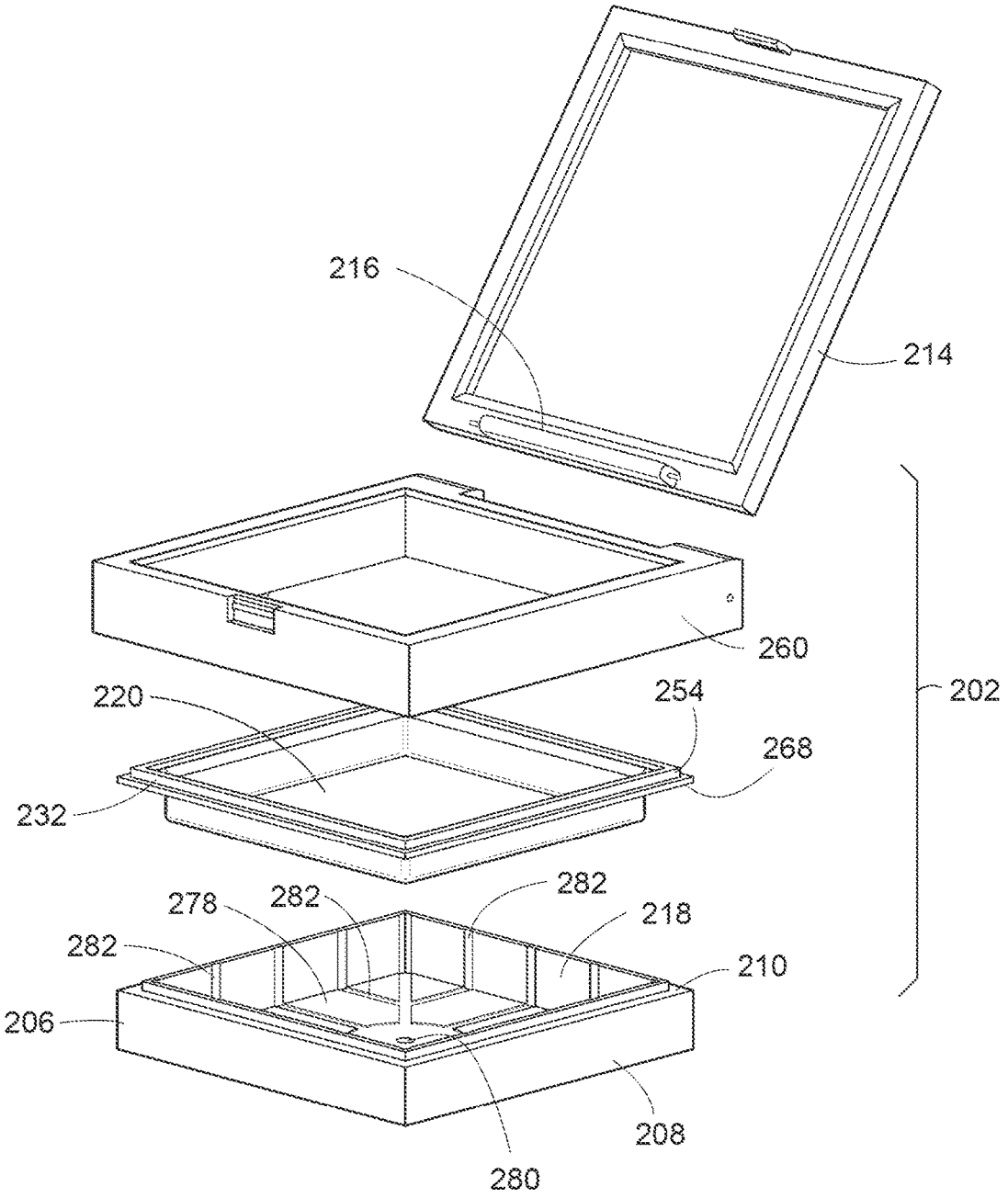
FIG. 15 is a perspective, exploded view of the compact shown in FIG. 14.

FIGS. 14-15 illustrate an embodiment that is square in plan view but that is otherwise similar to the round plan version shown in FIGS. 8-13. The square embodiment in FIGS. 14-15 includes a compact 202 having a rigid frame 206 and an elastic pan 220 similar to frame 6 and pan 20 described above. The frame 206 and pan 220 are enclosed in an outer shell 260. A cover 214 is pivotally attached to the shell 260 rather than to the frame 206. The cover 214 is attached to the shell 260 by a hinge 216 such that it can swing from an open position (shown) allowing access to the contents of the compact to a closed position (not shown) covering the contents of the compact. Instead of a hinge, the cover can be attached by snap fit or cooperating threads, etc. (not shown). The shell 260 provides a protective and/or decorative housing for the frame 206. As shown in FIG. 15, the pan 220 has an outwardly directed flange 232. The frame 206 has an upright wall 208 with a top rim 210. The upright wall 208 defines an upwardly opening chamber 218. A bottom wall 278 closes the bottom end of the chamber 218. The bottom wall 278 includes a vacuum port 280 adapted to be connected to a vacuum source. Alternatively, a vacuum port may be provided in the side wall as described above. The flange 232 on the pan 220 has a depending skirt 254. The skirt 254 has an outwardly directed bead 268. When the frame 206 and pan 220 are assembled, the flange 232 and skirt 254 contact the top rim 210 of the frame 206. A hermetic seal is formed with at least one of the flange 232, skirt 254 or bead 268 when the shell 260 is secured to the frame 206. The frame 206 may be attached to the shell 260 by welding, adhering, staking, friction fit, snap fit or any other suitable means for attaching, including, if required, with fasteners such as rivets, pins or screws. The frame 206 includes one or more vacuum channels 282 on inner surfaces of the frame to facilitate application and release of vacuum to the pan 220.

While the invention has been described and illustrated as embodied in preferred forms of construction, it will be understood that various modifications may be made in the structure and arrangement of the parts without departing from the spirit and the scope of the invention recited in the following claims.

What is claimed is:

1. A method for securing a cake of a cosmetic product in a compact case, the method comprising:

providing the case with a rigid frame with an upright wall having a top rim, the upright wall defining a chamber, the cake comprising one of a solid, a pressed powder, a paste or a semi-paste cosmetic, the cake having a predetermined size;

providing an elastomeric pan in the chamber, the pan having a floor and a sidewall defining a cake retention reservoir biased toward a first volume smaller than the predetermined size of the cake, a top end of the sidewall secured to the top rim of the upright wall of the frame by a horizontal flange such that a clearance is provided between the sidewall of the pan and the upright wall of the frame, and the reservoir is expandable to a second volume that is large enough to permit insertion of the cake into the reservoir;

expanding the reservoir of the elastomeric pan from the first volume to the second volume by temporarily sealing the frame against a vacuum source and applying a vacuum to the chamber such that the pan expands into the clearance;

inserting the cake into the reservoir while the reservoir is expanded to the second volume; and releasing the pan from the vacuum, wherein the reservoir contracts toward the first volume such that the inserted cake is securely grasped by the sidewall.

2. The method of claim 1 wherein the step of expanding the reservoir is accomplished by applying the vacuum to the chamber through an open bottom of the frame.

3. The method of claim 1 wherein the step of expanding the reservoir is accomplished by applying the vacuum to the chamber through a vacuum port in the frame.

4. The method of claim 3 wherein the frame is provided with a bottom wall and the vacuum port is located in the bottom wall of the frame.

* * * * *